United States Patent [19]

Bowser et al.

[11] 4,302,015

[45] Nov. 24, 1981

[54] CARD CONTROLLED ALIGNMENT GAME

[76] Inventors: Dale A. Bowser, 4525 S. Yukon, Tulsa, Okla. 74107; Gordon L. Howard, 8425 N. 121 E Ave., Owasso, Okla. 74055

[21] Appl. No.: 114,754

[22] Filed: Jan. 24, 1980

[51] Int. Cl.[3] ..... A63F 3/00

[52] U.S. Cl. ..... 273/271

[58] Field of Search ..... 273/271, 273

[56] References Cited

U.S. PATENT DOCUMENTS

| | | | |
|---|---|---|---|
| 1,480,360 | 1/1924 | Agee | 273/249 |
| 1,564,746 | 12/1925 | Barnard | 273/271 |
| 4,213,616 | 7/1980 | Dickey | 273/271 |

*Primary Examiner*—Anton O. Oechsle

*Attorney, Agent, or Firm*—Head & Johnson

[57] ABSTRACT

A game comprising of a game board in combination with playing cards and playing tokens and wherein the game board is inscribed with a plurality of contiguous or adjacent squares with each square having an individual and distinctive number imprinted thereon, and corresponding numbers being provided for the individual playing cards. The numbers inscribed on the game board are preferably arranged in such a manner that the number of least numerical value is disposed at the central portion of the game board, and the numbers increase in value toward the outer periphery of the game board. Each player is provided with a prescribed number of playing cards, face down, and the remaining cards are placed together in a pack. The players in turn place the playing tokens on selected squares of the game board in accordance with the numbers of the playing cards held, and the object of the game is to place a particular plurality of your own tokens in a line on the game board while blocking the opponents from similarly placing their tokens on the game board.

4 Claims, 3 Drawing Figures

| | | | | | | | | | |
|---|---|---|---|---|---|---|---|---|---|
| 73 | 74 | 75 | 76 | 77 | 78 | 79 | 80 | 81 | 82 |
| 72 | 43 | 44 | 45 | 46 | 47 | 48 | 49 | 50 | 83 |
| 71 | 42 | 21 | 22 | 23 | 24 | 25 | 26 | 51 | 84 |
| 70 | 41 | 20 | 7 | 8 | 9 | 10 | 27 | 52 | 85 |
| 69 | 40 | 19 | 6 | 1 | 2 | 11 | 28 | 53 | 86 |
| 68 | 39 | 18 | 5 | 4 | 3 | 12 | 29 | 54 | 87 |
| 67 | 38 | 17 | 16 | 15 | 14 | 13 | 30 | 55 | 88 |
| 66 | 37 | 36 | 35 | 34 | 33 | 32 | 31 | 56 | 89 |
| 65 | 64 | 63 | 62 | 61 | 60 | 59 | 58 | 57 | 90 |
| | 99 | 98 | 97 | 96 | 95 | 94 | 93 | 92 | 91 |
16 14 10 12
Fig. 1
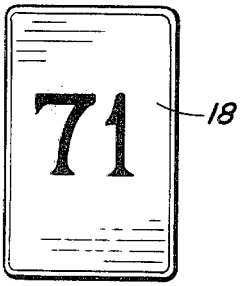
Fig. 2
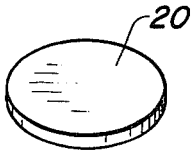
Fig. 3

CARD CONTROLLED ALIGNMENT GAME

BACKGROUND OF THE INVENTION

1. Field of the Invention

This invention relates to improvements in games and more particularly, but not by way of limitation, to a gameboard type game having numbers inscribed thereon for use in combination with corresponding numbers on playing cards to determine the positioning of playing tokens on the gameboard.

2. Description of the Prior Art

Gameboard type games are well known and games of this type involving numerical determinations and mental processes in the playing of the game are enjoying great popularlity today. Many of the presently available games of this type, however, are either extremely simple in play and the attraction to the playing of the game soon wanes, or the game is extremely complicated, and the entertainment aspect of the game may become lost in the exertion of mind required for the play.

SUMMARY OF THE INVENTION

The present invention contemplates a gameboard type game which has been particularly developed to overcome the foregoing disadvantages, and provides a novel game wherein the element of mental dexterity is combined with chance in a manner which is challenging and at the same time relatively easy and quick to learn and play. The gameboard is sectioned or inscribed with a plurality of adjacent squares, with each square being provided with its own distinctive number imprinted thereon. The numbers preferably begin with the numeral 1 and end with the numeral 99, and are placed consecutivly on the squares of the gameboard, with the numbers of least value being placed in the centrally disposed squares of the gameboard, and the numbers increasing in value in the direction toward the outer periphery of the gameboard. A plurality of playing tokens are provided for being placed on the individual squares during the play of the game, and a deck of cards is provided, with each card being imprinted with its own distinctive number. There is one card corresponding to each numbered square on the gameboard.

In the playing of the game, the deck of cards is shuffled and each player is dealt five cards, face down so that only the individual player is aware of the value of the cards in his possession. The first player begins the game by divulging the value of one of his playing cards and placing a token on the selected square which qualifies in accordance with the number of the card. On his next turn, he has the choice of drawing a card from the "pack" of cards or playing another token. At no time, however, may a player have more than five cards in his possession at one time. Thus, if a player possesses five cards when it is his turn to play he must show one of the cards and make the appropriate play on the gameboard. A player can never pass unless none of his cards will play.

The object of the game is for a player or team of players, to position five of his or the team's particular colored tokens in a row on the gameboard, whether in a cross row, up or down on the board, or diagonally therealong, just as long as the position of the numbered squares on the gameboard wherein the tokens are placed are disposed adjacent to each other. At the same time, each player must watch the progress of the tokens of the other players in order to place a token at a strategic location to prevent the placement of five "in line" tokens of the other players. Of course, the game session is ended when one of the players or team of players, is successful in placing five playing tokens in a line on the gameboard. The novel game is simple and exciting to play and yet challenging to one and all.

BRIEF DESCRIPTION OF THE DRAWINGS

FIG. 1 is a plan view of a gameboard for a game embodying the invention.

FIG. 2 is a plan view of a playing card utilized in a game embodying the invention.

FIG. 3 is a perspective view of a typical playing token utilized in a game embodying the invention.

DESCRIPTION OF THE PREFERRED EMBODIMENT

Referring to the drawings in detail, reference character 10 generally indicates a gameboard preferably of a substantially square planar configuration, and having a first plurality of mutually parallel spaced lines 12 inscribed thereon and extending thereacross in one direction and second plurality of mutually parallel spaced lines 14 inscribed thereon and extending thereacross in substantially perpendicular relationship with respect to the lines 12, thus forming a plurality of contiguous, or adjacent, in-line squares 16 on the playing surface of the gameboard 10. The squares 16 are suitably imprinted with individual numerals, as particularly shown in FIG. 1, said numerals being in numerical sequence, with the numbers of least value being placed in the centrally disposed squares 16, and the numbers increasing in value in a direction toward the outer periphery of the board. The numerals proceed outwardly from the centrally disposed numeral "1" in a spiral fashion, and end with the number "99" being placed at the outermost line of the sequence of numerals.

It will be apparent that the gameboard 10 as inscribed herein provides one hundred squares 16, and since it is preferable that the numerals imprinted on the board begin with the number 1 and end with the number 99, one square 16 on the board 10 will remain unnumbered and will not normally be used in the play of the game. Of course, it is to be noted that a different system of numbers may be imprinted on the board 10, is desired, wherein all of the squares 16 might be provided with its own individual number, or alternately, more than one square 16 might be unnumbered. In any event, the invention is not limited to the exact arrangement depicted herein.

A plurality of playing cards 18, preferably generally similar in size and configuration to the cards utilized in the playing of many games, such as bridge, and the like, are provided for the playing of the game. Each card 18 is imprinted with an individual number, as particularly shown in FIG. 2, there being a numbered card corresponding to each number imprinted on the squares 16 of the gameboard 10. In addition, a plurality of playing tokens 20 are provided for the playing of the game. The tokens 20 may be of any desired or suitable configuration, but it is preferable that the tokens 20 be of a substantially flat disc shape having a diametric dimension corresponding to the size of the squares 16 whereby a single token 20 may be placed on a single square 16 without interference with any token placed on an adjacent square during the playing of the game. It is also preferable to provide sets of the tokens 20 of having corresponding identification means, such as a plurality of red tokens, a plurality of blue tokens, a plurality of yellow tokens, or the like, whereby each player or team players of the game is provided with his own identifiable tokens.

In the play of the game, the gameboard 10 is initially placed in a substantially horizontal position, with the squares 16 being visible and accessible by all the players of the game. The tokens 20 are distributed among the players, with each player having his own set of identifiable tokens.

The cards 18 are shuffled in the usual or well known manner, and are dealt or distributed among the players in such a manner that each player is provided with a identical quantity of playing cards. It is preferable that each player be provided with five cards, but not limited thereto. The cards which are not distributed to the players are placed together in a pack and placed face down at a position accessible to each player. The play of the game may then be commenced, and the selection of the particular player to initiate the playing of the game may be accomplished in any suitable or well known manner, such as by the throw of a dice, cutting of the cards prior to the shuffling thereof, or the like. Each player, of course, retains the cards dealt to him at the initation of the play, and it is preferable that the value of the cards be kept confidential or not revealed to the other players prior to the play of the card during the playing of the game.

The play of the game begins by the first player selecting one of the cards in his hand, and placing it in a convenient place, with the number on the card being visible to the others players. He may then place one of his playing tokens on any square 16 of gameboard which has a number imprinted thereon either equal to or higher than the number of the exposed card. The selected card may not be used again during the play of the game, and thus becomes a discard, and it is preferable that all of each players discards be placed in a "pile" in front of him, with the number of the card being exposed. Once a token has been placed on a square, it remains there throughout the entire game, and no other token may be placed on that particular square.

Each player proceeds in the same manner, moving from player to player in sequence around the gameboard. At each play, the player has an option to select a card from his hand or to "draw" an unexposed card from the pack left from the original dealing of the cards. It is to be noted, however, that at no time may a player have more than five cards in his hand. If he does not or cannot play one of the five cards he holds then he must pass in favor of the next succeeding player.

The object of the game is for one player or team of players to position five of their particular tokens in a line on adjacent squares 16 of the gameboard. The tokens may be in a line vertically, horizontally, or diagonally as viewed in FIG. 1, as long as the five squares are in either abutting relationship, or "corner-to-corner" relationship. The game session is ended when any one player is able to so position five of his tokens. Of course, while keeping one's own game strategy in mind, it is also important to be aware of the play of each other player, and if any of the other players appears to be approaching a "five in a row" condition with his tokens, it is desirable to place one of his own tokens among those of the said other player to "block" the possible "five in a row" condition for the opponent.

From the foregoing it will be apparent that the present invention provides a novel gameboard type game wherein a certain amount of skill is coupled with chance to provide a entertaining and though provoking pastime. The novel gameboard is simple and economical in construction, and the playing of the game may be readily learned, yet the skill developed in the playing of the game is sufficiently challenging as to provide for long periods of amusement.

Whereas the present invention has been described in particular relation to the drawings attached hereto, it should be understood that other and further modifications, apart from those shown or suggested herein may be made within the spirit and scope of this invention.

What is claimed is:

1. A board-type game comprising a game board having a plurality of playing areas inscribed thereon, individual non-repeating identifying numerals imprinted on the playing areas and arranged in a logical sequence in concentrically increasing numerical patterns on the playing areas, a plurality of playing cards individually corresponding in number with the playing areas and independently identified in accordance with each of the identifying numerals of the playing areas, and a set of identifiable playing tokens provided for each game player and adapted for selective disposition by the respective players on the playing areas as selected by the corresponding nature between the playing areas and playing cards.

2. A board-type game as set forth in claim 1 wherein the individual playing areas comprise a plurality of contiguous squares inscribed on the gameboard.

3. A board-type game as set forth in claim 2 wherein the numbers begin with the numeral 1 and continue consecutively through the numeral 99.

4. A board-type game as set forth in claim 3 wherein the numerals 1 is inscribed in the proximity of the center of the gameboard, and the remaining numerals are arranged in increasing consecutive sequence in a substantially circular pattern in a direction toward the outer periphery of the gameboard.

* * * * *